US006269670B2

(12) United States Patent
Koestermeier

(10) Patent No.: US 6,269,670 B2
(45) Date of Patent: Aug. 7, 2001

(54) METHOD FOR FORMING A WORKPIECE BY FLOW-FORMING

(75) Inventor: Karl-Heinz Koestermeier, Rietberg (DE)

(73) Assignee: Leico GmbH & Co. Werkzeugmaschinenbau, Ahlen (DE)

( * ) Notice: Subject to any disclaimer, the term of this patent is extended or adjusted under 35 U.S.C. 154(b) by 0 days.

(21) Appl. No.: 09/332,755

(22) Filed: Jun. 16, 1999

(30) Foreign Application Priority Data

Jul. 9, 1998 (DE) ..... 198 30 817

(51) Int. Cl.[7] ..... B21D 22/16
(52) U.S. Cl. ..... 72/85; 72/96
(58) Field of Search ..... 72/78, 83, 85, 72/96; 29/893.32

(56) References Cited

U.S. PATENT DOCUMENTS 455,336 * 7/1891 Johnston ..... 72/78
1,596,751 * 8/1926 Millspaugh ..... 72/126
3,076,359 * 2/1963 Mayo ..... 72/96
4,551,122 * 11/1985 Kraft et al. ..... 72/83
4,693,105 * 9/1987 Lee, Jr. ..... 72/84
4,872,250 * 10/1989 De Marco ..... 72/96
6,026,666 * 2/2000 Zimmermann et al. ..... 72/85

FOREIGN PATENT DOCUMENTS 3402301 8/1985 (DE) .
43 136 48 10/1994 (DE) .
196 36 567 7/1997 (DE) .

* cited by examiner

*Primary Examiner*—Lowell A. Larson
(74) *Attorney, Agent, or Firm*—Oblon, Spivak, McClelland, Maier & Neustadt, P.C.

(57) ABSTRACT

The invention relates to a method for working or forming a workpiece by flow-forming, particularly for the manufacture of internal teeth on the workpiece, in which a cup-shaped preform or blank is axially fixed against a tool chuck and pressed by means of at least one rolling body onto said tool chuck and the blank is rotated relative to the rolling body, the at least one rolling body, at the start of forming, at the open end of the blank is pressed against the cylinder wall area thereof and in axial relative movement is guided in forming contact over the cylinder wall area to the base of the blank.

8 Claims, 4 Drawing Sheets

METHOD FOR FORMING A WORKPIECE BY FLOW-FORMING

BACKGROUND OF THE INVENTION

The invention relates to a method for working or forming a workpiece by flow-forming, particularly for the manufacture of internal teeth on the workpiece, in which a cup-shaped preform or blank is axially fixed against a tool chuck and pressed by means of at least one rolling member onto the tool chuck and the blank is rotated relative to the rolling member.

Numerous different methods are used in the non-cutting manufacture of internal teeth by flow-forming. Thus, DE 196 36 567 A1 (cf. FIG. 4) describes a manufacturing method called climb-stretching. In the climb-stretching manufacturing method, a blank is radially centered and fixed by an axial pressure against the tool chuck. The feed movement of the spinning rollers takes place from the tailstock side, so that the spinning rollers set to the external diameter of the workpiece reduce the external diameter of the blank and press the material into the profile on the circumference of the tool chuck and thereby roll it out in the axial direction.

DE 196 36 567 A1 (cf. FIG. 5) describes the manufacture of internal teeth by radial rolling in. The blank is radially centered and axially fixed on the base side, so that in the case of a radial infeeding of the spinning rollers the displaced material radially and axially penetrates the profile of the tool chuck.

In another method variant (cf. DE 196 36 567 A1, FIG. 6), the preform or blank is radially centered and axially fixed on both sides, so that on a radial infeeding of the spinning rollers, the displaced material penetrates and fills the tool chuck profile.

Finally, in the case of a climb-stretching with axial stop member (cf. DE 196 36 567 A1, FIG. 7), the blank is radially centered and axially fixed on the base side of the blank. In the axial direction, the tool chuck carries a stop member against which the material flows during flow-forming and which stops the material as soon as, through the feed movement, the spinning rollers, set to an external diameter of the workpiece, are moved from the tailstock side against the blank and displace the material. In this method, the material can only penetrate in the radial direction into the tool chuck profile and can increase in diameter against the frictional resistance of a stop member face.

In all these methods the radial bulging problem arises, being caused by the mutual spacing of the spinning rollers, which occurs due to the geometrical dimensions of the spinning rollers with their bearings. The consequence is a reversed loading in the tool chuck profiles during working or forming.

It is also common to all these methods that at the start of forming, the radial resistance of the material, from the ring-shaped transition area between the base and wall of the blank, must be overcome. To this, must be added the support of the wall of the blank on the toothed crests of the tool chuck. Thus, varying forming forces due to the different resistance during the forming of the blank lead to different workhardnesses within the shaped profiles in the workpiece. As constant forming forces are a prerequisite for constant tolerance ranges on the workpiece profile, a fluctuating tolerance range must be expected. This is a method-caused, serious disadvantage during the manufacture of workpieces requiring precise dimensioning in accordance with the aforementioned methods.

SUMMARY OF THE INVENTION

Thus, the object of the present invention is to provide a method in which, for obtaining a high-quality workpiece, the forming resistance of the blank is virtually constant in the vicinity of the inner profile during flow-forming.

In the aforementioned method, this object is achieved according to the present invention in that the at least one rolling body, at the start of forming, at the open end of the blank, is pressed against the cylinder wall area thereof and is guided, in forming contact, in axial relative movement, over the cylinder wall area to the base of the blank. As a result of the start of flow-forming at the open side of the blank, throughout the forming path a constant material cross-section is available for shaping. As a result, the necessary forming force remains substantially constant, so that there is a constant tolerance range of the formed profile. The axial relative movement can be effected by an axial movement of the blank with respect to an axially stationary rolling body, by an axial movement of the rolling body with respect to an axially stationary blank or by a combined movement of the rolling body and the blank.

According to the present invention, a reliable profiling of the inside of the blank is achieved in that axial teeth are shaped on the cylinder wall area with an axial length smaller than the length of the cylinder wall area and that the shaped internal teeth have a clearly defined spacing from the base. In the flow-forming according to the present invention from the open side of the blank, material can be moved in the direction of the base. According to the present invention, a free space is provided between the desired internal teeth and the base, in which the axially displaced material can be received without any undesired compression. The at least one rolling body thereby overtravels the cylinder wall of the blank not completely to the base, but instead stops at a clearly defined, axial distance in front of the base area. With a through, axial construction of the outer profile on the tool chuck, it is e.g. possible to provide an adequate free space. It is alternatively possible to have a special, ring-shaped groove on the tool chuck adjacent to the base of the fixed blank. This ensures that a necessary, axial length of the internal teeth can be reliably flowformed on the workpiece.

According to the present invention, it is preferable to form a transition contour with a wall thickness increase in a corner area between the base and the cylinder wall area. In the corner area between the substantially radially directed base and the substantially axially directed cylinder wall area, the maximum bending load occurs if the formed workpiece is e.g. used as a toothed gear part. As there is no clearly defined shape development of the internal teeth on the inside of the corner area, a reliable, high strength is achieved by a specially constructed transition contour with a wall thickness increase compared with the shaped cylinder wall area. The transition area preferably has a conical contour, which tapers from the base to the cylinder wall area.

If, according to a preferred variant, the blank is formed or worked by a plurality of rolling bodies arranged in a ring-like manner around the blank and mounted in a rotary manner in a cage, in each case, the blank can be supported and simultaneously formed by the geometrically maximum number of spinning rollers, rolls or balls on the circumference during the rotation thereof. The rolling bodies, to be formed, orbit the blank in planet-like manner, when contacting and forming the blank.

In the known spinning rollers, due to the separate mounting and control of the spindles as a result of the axial displacement of the rollers, one roller always commences the shaping process, so that there is necessarily a tool deflection until further axially displaced rollers come into use. As a result of this alternating deflection of the forming tool, a uniform loading and a self-centering are not possible. However, in the present variant of the inventive method, the force is uniformly transferred symmetrically via an outer race of a bearing to all the rollers. All the rollers are simultaneously involved in the forming process. The inner tool can be independently centered and is uniformly loaded.

The blank is appropriately moved in an axial relative movement through the ring-like rolling body arrangement and is pressed by the rolling bodies onto the spinning or tool chuck. Alternatively, the rolling bodies mounted in the cage can be radially infed.

If, in a preferred manner, the blank is formed by conical spinning rolls, which roll in an arrangement inclined to the blank rotation axis in a conical outer race, an improved centering can be achieved on introducing the blank into the rolling arrangement. Due to an axial displacement and positioning of the rolling bodies with the cage, a radial positioning and setting of the rolling bodies is possible.

The preform or blank is appropriately fixed between two axially movable drive spindles of a flow-forming machine and on one of the drive spindles is provided the tool chuck and on the other drive spindle a centering device is provided. The blank is initially arranged and kept centered on the drive spindle with the centering device and for fixing the blank to the tool chuck the drive spindles are moved axially against one another. The movement unit formed by the two drive spindles and the blank can then be moved for producing a feed movement, so that rapid fixing and forming occur.

Preferably, the centering device is constituted by a centering pin, on which the blank is mounted in accurately fitting manner with a hub opening. The centering pin and hub opening can form a clearance fit or a slight press fit, which ensures that the blank is initially fixed on one drive spindle. For fixing the blank to the tool chuck, the facing drive spindle is axially introduced into the cup, the base area of the blank being fixed between the two drive spindles. The two mutually moved drive spindles form a unit, which is then preferably moved with the workpiece through an axially fixed forming device with the at least one rolling body.

The blank can, in each case, be moved with the open side towards the forming tool, i.e. the open side of the blank faces the large diameter of the conical reception opening formed by the rolling bodies.

The spacing between the rollers is reduced to a minimum as a result of the large number of rollers. Thus, the radial bulge of the blank and therefore the reversed loading on the tool chuck profiles are reduced to a minimum and a uniform material hardening is obtained.

BRIEF DESCRIPTION OF THE DRAWINGS

The invention is described hereinafter relative to an embodiment and with reference to the attached drawings, wherein show.

DETAILED DESCRIPTION OF THE INVENTION

Figure 2:
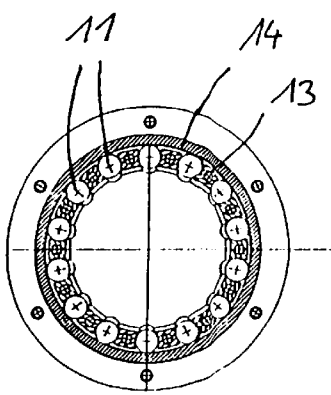
FIG. 2 is a cross-sectional view of the device of FIG. 1 shown at a right angle to a machine rotation axis.
Figure 3:
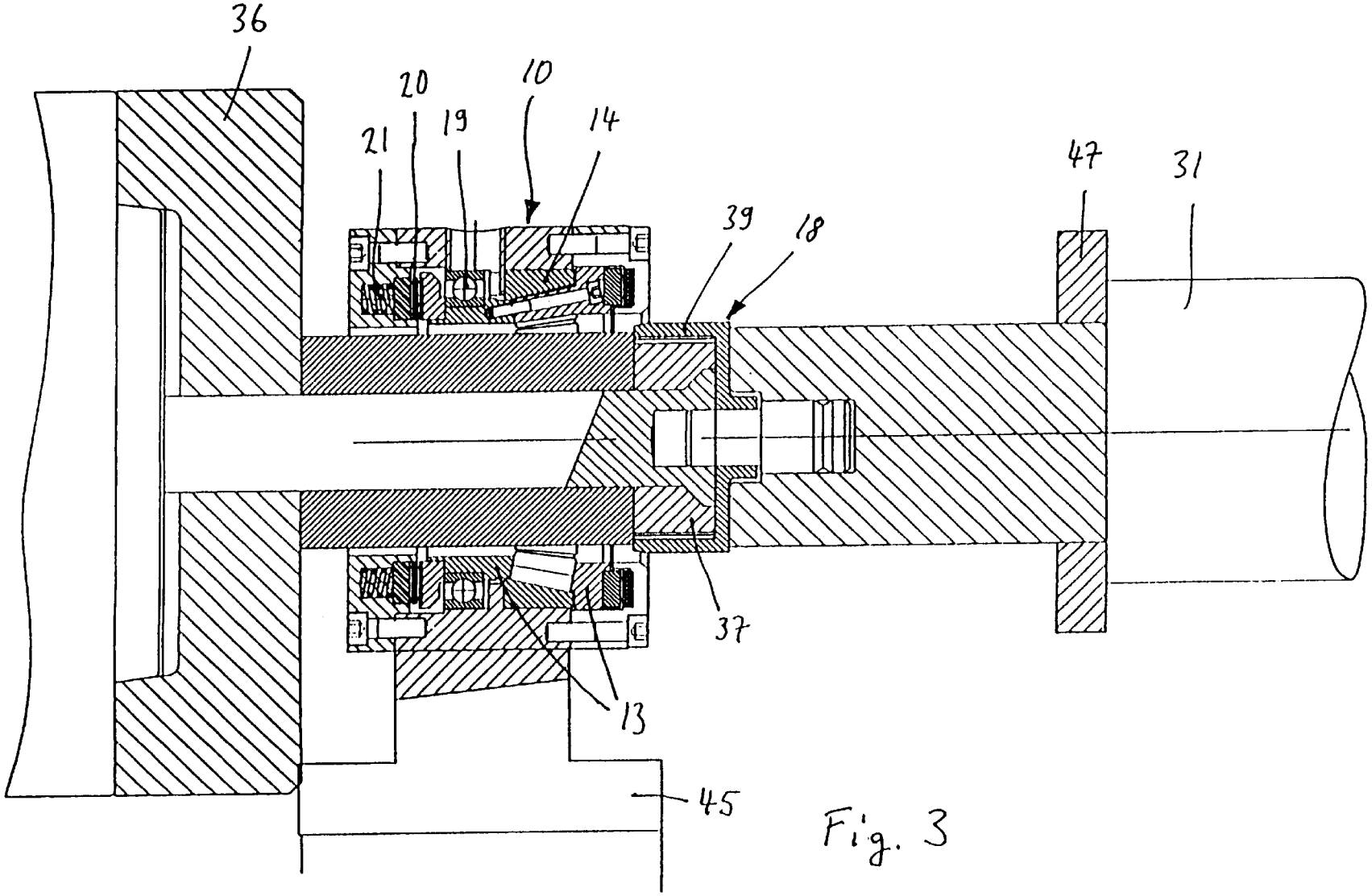
FIG. 3 is a cross-sectional view of the device in FIG. 1 showing a blank fixed on a tool.

A device 10 or a forming or working tool for performing the method according to the present invention (cf. particularly FIGS. 1 to 3) has a plurality of rollers 11, as rolling bodies or spinning rolls, in a ring-like arrangement (in the represented embodiment there are 14 rollers, cf. FIG. 2), which are received in recesses, which are constructed in a ring-shaped support member or cage 13 of the device 10, and are axially and radially guided. A fixed, outer ball race or outer race 14 is inserted in a casing 15 of the device 10 and forms an outer, hardened track 16 for the rollers 11, while an inner track is formed by a blank 18 to be worked. By means of a ball bearing 19, the ring-shaped support member 13 is mounted radially and in rotary manner in the casing 15 of device 10. An axial bearing 20, e.g. a needle bearing, axially supports the support member 13 by means of a spring mechanism, e.g. in the form of several helical springs 21, on a casing terminating part 22 connected e.g. by screwing to the casing 15.

Figure 1:
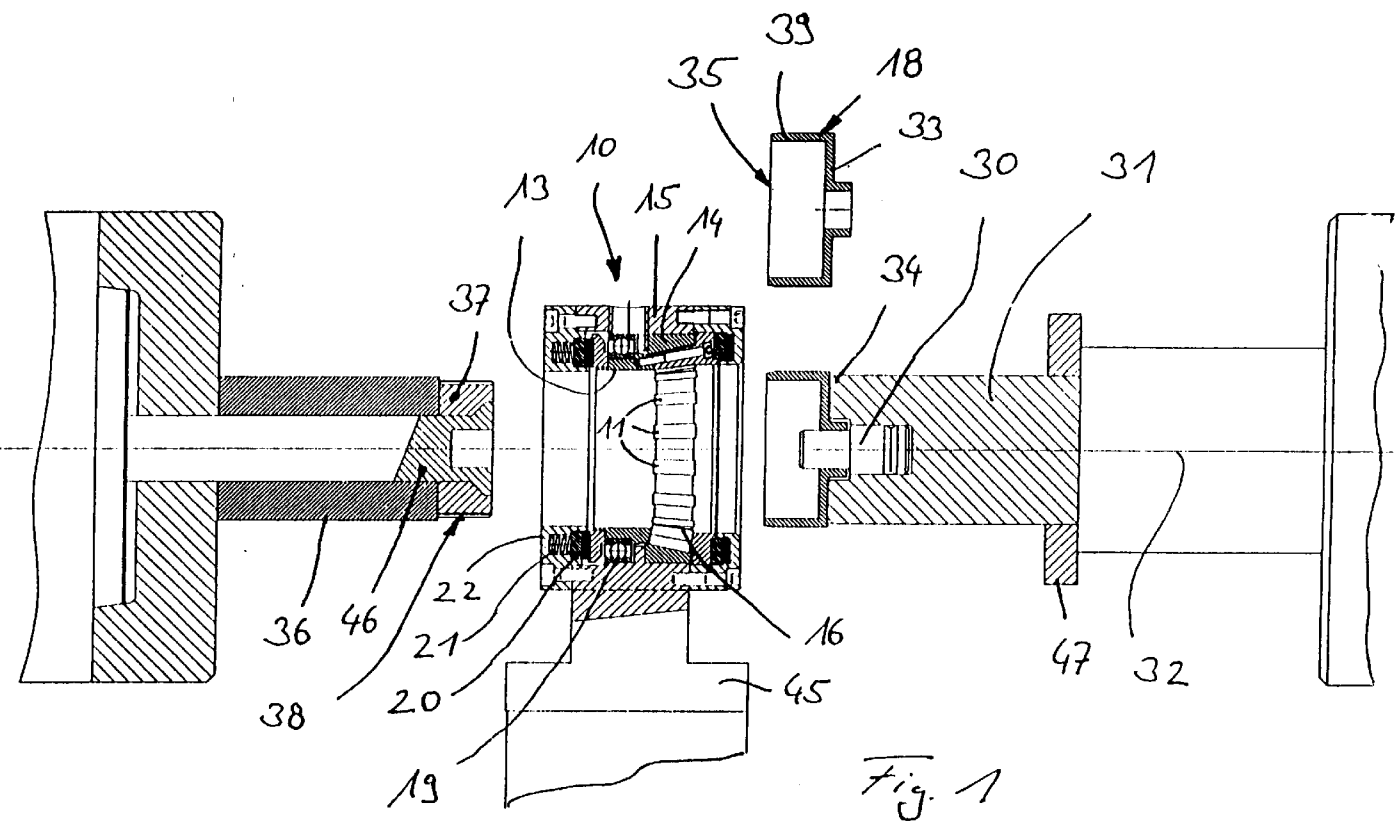
FIG. 1 is a cross-sectional view showing a partial representation of a flow-forming machine with a device for performing the method according to the present invention in a loading position.
Figure 6:
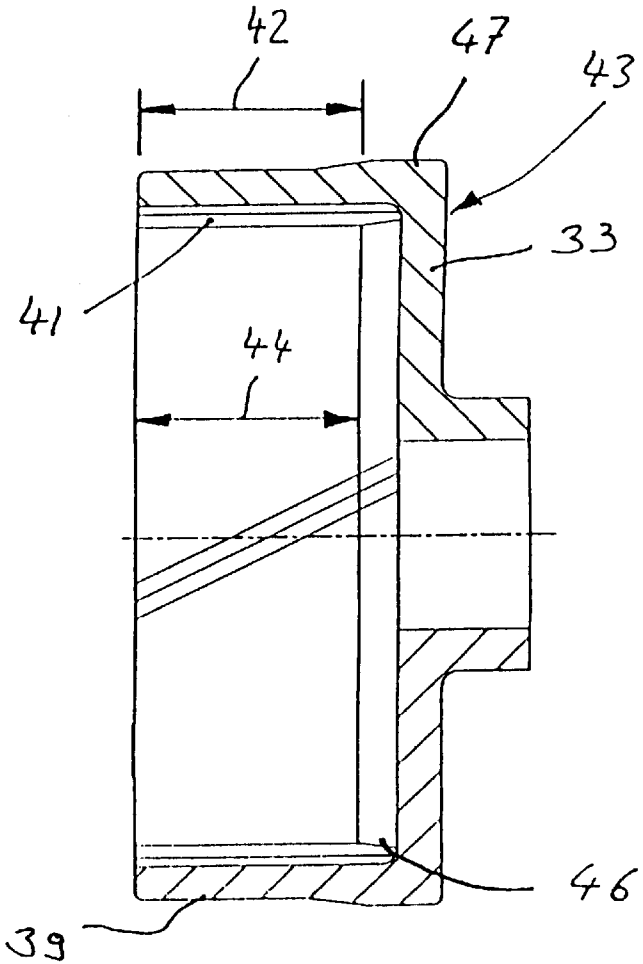
FIG. 6 is a cross-sectional view of a workpiece having internal teeth produced by forming the blank shown in FIG. 5.
Figure 5:
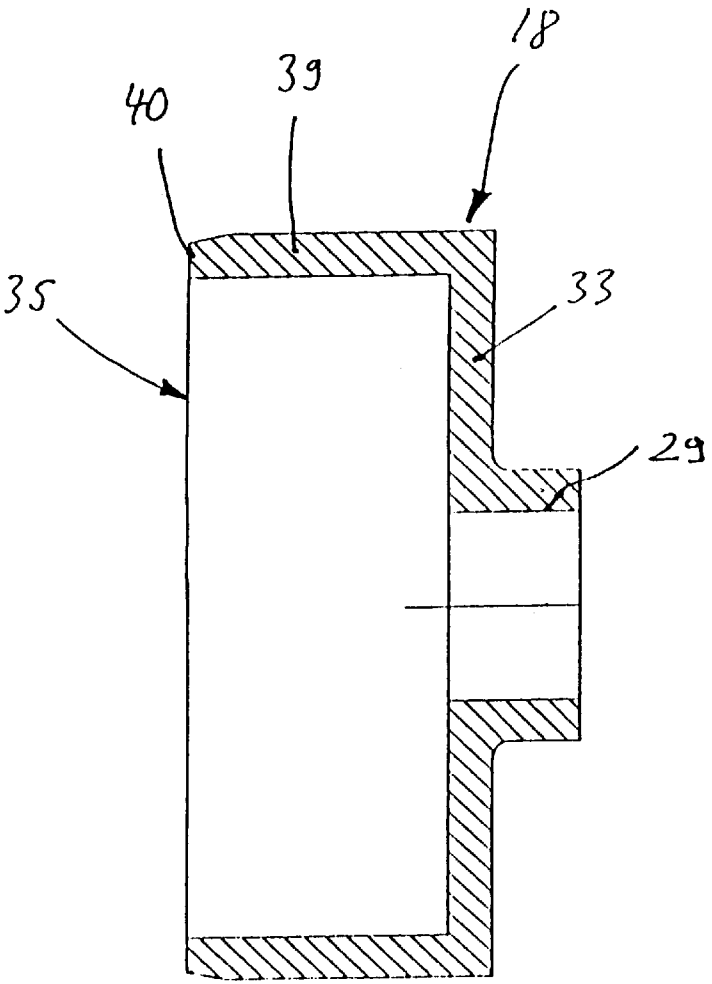
FIG. 5 is a cross-sectional view of a blank, which is to have internal teeth formed thereon in accordance with the method of the present invention.

FIG. 1 shows the arrangement of the device 10 for flow-forming internal teeth in a diagrammatically represented flow-forming machine. The cup-shaped blank 18 on a centering pin 30, which forms a fit with a hub opening 29 of the blank 18, is received and held on a first, right-hand drive spindle 31, serving as the pressing member, coaxially to the rotation axis 32 thereof. The base 33 of the blank 18 is applied to the front 34 of the drive spindle 31, so that the open end 35 of the blank 18 points towards a coaxially positioned, second, left-hand drive spindle 36, on which is fixed a tool chuck 37 with a tooth profile 38. The internal diameter of the blank 18 roughly corresponds to the external diameter of the tool chuck 37. The left-hand drive spindle 36 is axially moved against the right-hand drive spindle 31 until the tool chuck 37 has been introduced into the blank 18 and the base 33 of the blank 18 has been fixed against the right-hand drive spindle 31 (cf. FIG. 3). As a result of a rotational drive of the left-hand drive spindle 36 and/or right-hand drive spindle 31, the blank 18 is rotated. The unit formed by the left and right-hand drive spindles 36 and 31, together with the blank 18 jammed between them is then, given an axial feed movement by the device 10 (cf. FIG. 4). The free end 40 of the cylinder wall area 39 at the open end 35 of the blank 18 is introduced into the larger diameter of the ring formed by the conically adjusted rolling bodies 11 and pressed against the rolling bodies. During the axial feed movement of the cylinder wall area 39 at the open end 35 of the blank 18 being introduced into the larger diameter of the ring formed by the conically adjusted rolling bodies 11 and pressed against the rolling bodies, the diameter is reduced from the open end 35 of the blank 18 (cf. FIG. 4), so that by rolling the depressions, on the toothed profile 38 of the tool chuck 37, are filled by material of the cylinder wall area 39 and the inner profile or internal teeth 41 (cf. FIG. 6) are produced. The length of the feed movement or feed path 42 is reached when the internal teeth 41 or inner profile has been formed in a inner length 44 in the workpiece 43 constituted by the blank 18 and a clearly defined spacing 46 or free space with respect to the base 33 is maintained. Furthermore, between the base 33 and the shaped-in internal teeth 41 on the cylinder wall area 39, a transition contour 47 with an increased wall thickness is formed, through which there is a planned reinforcement of the highly loaded corner area of the workpiece 43.

In this embodiment, the device 10 or the forming tool is fixed to a radially infeedable transfer support 45 of the flow-forming machine, so that the casing 15 is stationary and the rolling bodies 11 with their cage 13 rotate about the rotation axis 32. The flow-forming machine can also be built up in such a way that the transfer support 45 is axially movable and performs the axial feed movement of the device 10 or forming tool with axially stationary drive spindles 31, 36.

Figure 4:
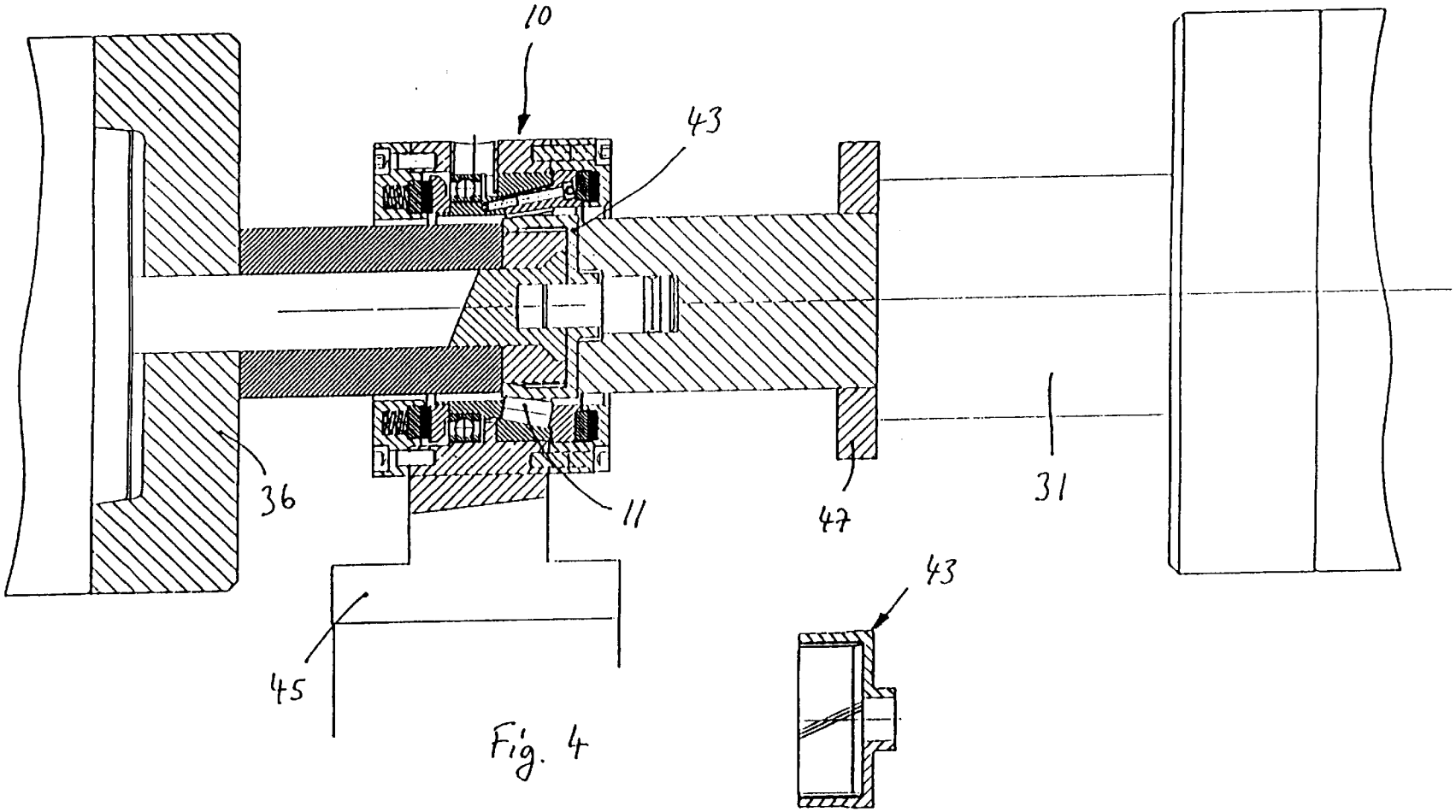
FIG. 4 is a cross-sectional view of the device of FIG. 1 in an operating position during the forming of the blank in a view according to FIG. 3.

At the end of the feed movement, i.e. following the forming of the blank 18 and the production of the inner profile or internal teeth 41, an ejector 48, located in the left-hand drive spindle 36, is subject to an axial compressive force (force action to the right in FIG. 4). During the axial return movement of the two drive spindles 31, 36, the finish-machined workpiece 43 is moved out of the device 10 or forming tool and slid off the left-hand drive spindle 36 or tool chuck 37. As soon as the left-hand drive spindle 36 has reached its starting position and the right-hand drive spindle 31 has moved back from the left-hand drive spindle 36 into its starting position, the workpiece 43 is moved from the right-hand drive spindle 31 by a stripper 49. A new cycle for the production of the next workpiece can now commence.

What is claimed is:

1. Method of flow-forming a workpiece having completely formed internal teeth, said method comprising the steps of:

axially fixing a cup-shaped blank against a tool chuck;

pressing said blank onto said tool chuck using a plurality of rolling bodies;

rotating said blank relative to said plurality of rolling bodies;

pressing said plurality of rolling bodies, which are located in a ring-like arrangement around a rotational axis of said blank, at a start of the flow-forming and at an open end of said blank, which is against a cylindrical wall area of said blank, to form said internal teeth, without elongating an axial length of said teeth so that material flow, in an axial direction away from a base of said blank, is prevented, and better filling of a profile of said tool chuck is achieved;

flow-forming said blank through contact with said plurality of rolling bodies, wherein the flow-forming comprises contacting said blank with conical rolling members which roll in an inclined manner in a conical ball race with respect to said rotational axis of said blank; and guiding said plurality of rolling bodies in an axial relative movement over said cylindrical wall area of said blank to said base of said blank, said base of said blank being in forming contact.

2. Method according to claim 1, further comprising forming internal teeth on said cylindrical wall area at a clearly defined distance from said base, wherein said internal teeth have an axial length smaller than a length of said cylindrical wall area.

3. Method according to claim 1, farther comprising forming a transition contour in a comer area between said base and said cylindrical wall area, wherein said transition contour has an increased wall thickness.

4. Method according to claim 1, further counting each of said plurality of rolling bodies in a rotary manner in a cage.

5. Method according to claim 4, further comprising moving said blank in an axial relative movement through amid ring-like arrangement of said plurality of rolling bodies and pressing said blank by said plurality of rolling bodies onto said tool chuck.

6. Method according to claim 4, further comprising forming said blank with a plural conical rolling bodies, wherein each of said plurality of conical rolling bodies roll in a conical outer race inclined to a rotation axis of said blank.

7. Method according to claim 1, further comprising fixing said blank between two axially movable drive spindles of a flow-forming machine, wherein said tool chuck is provided on first of said two axially movable drive spindles and a centering device is provided on a second of said two axially movable drive spindles, wherein said centering device initially positions and keeps said blank centered and wherein said two axially movable drive spindles are moved axially against each other to fix said blank on said tool chuck.

8. Method according to claim 7, further comprising mounting said blank in an accurately fitting manner on a centering pin of said centering device with a hub opening.

* * * * *